US009640851B2

(12) United States Patent
Nantista et al.

(10) Patent No.: US 9,640,851 B2
(45) Date of Patent: May 2, 2017

(54) RF WAVEGUIDE PHASE-DIRECTED POWER COMBINERS

(71) Applicant: The Board of Trustees of the Leland Stanford Junior University, Palo Alto, CA (US)

(72) Inventors: Christopher D. Nantista, Redwood City, CA (US); Valery A. Dolgashev, San Carlos, CA (US); Sami G. Tantawi, Stanford, CA (US)

(73) Assignee: The Board of Trustees of the Leland Stanford Junior University, Palo Alto, CA (US)

( * ) Notice: Subject to any disclaimer, the term of this patent is extended or adjusted under 35 U.S.C. 154(b) by 0 days.

(21) Appl. No.: 14/722,048

(22) Filed: May 26, 2015

(65) Prior Publication Data

US 2015/0340752 A1 Nov. 26, 2015

Related U.S. Application Data

(60) Provisional application No. 62/003,002, filed on May 26, 2014.

(51) Int. Cl.

| | |
|---|---|
| ***H01P 5/20*** | (2006.01) |
| ***H01P 5/12*** | (2006.01) |
| ***H01P 1/165*** | (2006.01) |
| *H01P 3/12* | (2006.01) |

(52) U.S. Cl.

CPC ..... *H01P 5/12* (2013.01); *H01P 1/165* (2013.01)

(58) Field of Classification Search

CPC ..... H01P 5/181; H01P 5/182; H01P 1/025; H01P 1/027

USPC ..... 333/108, 113, 117

See application file for complete search history.

(56) References Cited

U.S. PATENT DOCUMENTS

| | | | | |
|---|---|---|---|---|
| 2,801,391 A * | 7/1957 | Whitehead | H01P 5/16 | 333/122 |
| 3,235,822 A * | 2/1966 | Loach, Jr. | H01P 1/208 | 333/212 |
| 3,678,415 A * | 7/1972 | Kuroda | H01P 5/227 | 333/114 |
| 3,731,217 A * | 5/1973 | Gerst | H01Q 3/40 | 330/124 R |
| 3,827,051 A * | 7/1974 | Foldes | H01Q 21/24 | 333/117 |
| 3,864,683 A * | 2/1975 | Morz | H01Q 25/04 | 342/153 |
| 3,877,031 A * | 4/1975 | Mailloux | H01Q 25/04 | 342/379 |

(Continued)

OTHER PUBLICATIONS

Tantawi et al., Active and Passive RF Components for High-Power Systems, Sep. 2002, SLAC, PUB-9499, 17 pages.*

(Continued)

*Primary Examiner* — Dean Takaoka
(74) *Attorney, Agent, or Firm* — Lumen Patent Firm

(57) ABSTRACT

High power RF phase-directed power combiners include magic H hybrid and/or superhybrid circuits oriented in orthogonal H-planes and connected using E-plane bends and/or twists to produce compact 3D waveguide circuits, including 8×8 and 16×16 combiners. Using phase control at the input ports, RF power can be directed to a single output port, enabling fast switching between output ports for applications such as multi-angle radiation therapy.

8 Claims, 10 Drawing Sheets

(56) References Cited

U.S. PATENT DOCUMENTS 3,893,124 A * 7/1975 Barker ..... G01S 13/422 342/368
4,514,699 A * 4/1985 Kariatsumari ..... H01P 5/16 330/286
4,757,281 A * 7/1988 Anne ..... H01P 1/067 333/117
4,864,321 A * 9/1989 Sureau ..... H01Q 15/0013 343/700 MS
5,105,170 A * 4/1992 Joshi ..... H01P 5/16 330/295
5,229,728 A * 7/1993 Carvalho ..... H01P 5/12 29/600
5,274,839 A * 12/1993 Kularajah ..... H01P 5/182 333/113
5,724,839 A * 3/1998 Thering ..... B60R 25/09 70/18
6,411,174 B1 * 6/2002 Crouch ..... 331/108 C
7,564,421 B1 * 7/2009 Edwards ..... H01Q 13/0241 333/137
8,797,122 B2 * 8/2014 Lee ..... H01Q 3/40 333/117
9,065,162 B2 * 6/2015 Runyon ..... H01P 5/12
9,112,255 B1 * 8/2015 Hollenbeck ..... H01P 5/182
9,350,064 B2 * 5/2016 Tatomir ..... H01P 5/20
9,373,880 B2 * 6/2016 Tatomir ..... H01P 3/12
9,401,535 B2 * 7/2016 Tabatabaei ..... H01P 5/12
2012/0112963 A1 * 5/2012 Lee ..... H01P 5/12 342/373

OTHER PUBLICATIONS

Tantawi et al., Multimoded rf delay line distribution system for the Next Linear Collider, 2002, The American Physical Society, vol. 5, 032001, 8 pages.*

Nantista et al., A Planar, rectangular waveguide launcher and extractor for a dual-moded RF power distribution system, Aug. 2000, THA08, 3 pages.*

Nantista et al., "A Compact, Planar, Eight-Port Waveguide Power Divider/Combiner: The Cross Potent Superhybrid," IEEE Microw. Guid. Wave Lett. 10 (2000) 520-522.

Nantista et al., "Planar Waveguide Hybrids for Very High Power RF," presented at the 1999 Particle Accelerator Conference, New York, NY, Mar. 29-Apr. 2, 1999; SLAC-PUB-8142.

* cited by examiner

RF WAVEGUIDE PHASE-DIRECTED POWER COMBINERS

CROSS-REFERENCE TO RELATED APPLICATIONS

This application claims priority from U.S. Provisional Patent Application 62/003,002 filed May 26, 2014, which is incorporated herein by reference.

STATEMENT OF GOVERNMENT SPONSORED SUPPORT

This invention was made with Government support under Contract DE-AC02-76SF00515 awarded by the Department of Energy. The Government has certain rights in the invention.

FIELD OF THE INVENTION

The present invention relates generally to high power RF waveguide networks. More specifically, it relates to improved phase-directed power combiners and related methods.

BACKGROUND OF THE INVENTION

In certain high power RF applications, pulsed RF power is needed at multiple different loads at different times. For delivery to n loads, this may be implemented using n separate sources and transmission lines, with appropriately coordinated timing. Rather than having each source connected to a single load, another approach is to use phase directed combining to send power from multiple sources to a selected one of the desired loads, allowing power to be sequentially routed to different individual loads by changing the input phases. This approach allows the peak power requirement to be reduced by roughly a factor of n. It may be implemented using a high power RF switching circuit. For example, four-port hybrids may be used for combining power in waveguide by controlling the relative phase of the inputs to selectively direct power out of either output.

As shown in FIG. 1, a traditional 2×2 waveguide hybrid has a pair of rectangular waveguides joined to allow matched directional coupling. This particular "magic-H" configuration, originated by the inventors, has mitred bends at all four ports and appropriate adjustment of the dual-moded width section to allow combining the input power at the two right ports 102, 106 to be selectively directed to one of the two left output ports 100, 104. Removal of sharp-edged wall apertures, which can be prone to breakdown, makes this geometry eminently suited for use in high power applications. It also avoids the use of posts, common in magic-Ts. The waveguide height of this 2-D design can be raised to further increase power handling. Note that this H-plane geometry can be employed to design couplers with arbitrary power division. The figure shading indicates the electric field strength for a particular example where 9.3 GHz power is directed from the right input ports 102, 106 to the left output port 104. The fields at the input ports 102, 106 are 90° out of phase.

If the port widths are constrained to be half the center width and the mitres 45°, the particular symmetry of the 2×2 hybrid design of FIG. 1 allows it to be merged with three other 2×2 hybrids radially arranged to create an 8-port 4×4 "cross potent" superhybrid waveguide circuit, as shown in FIG. 2. The resulting 8-port device has four input ports (a pair of ports 200, 202 on the top and a pair of opposite ports 204, 206 on the bottom) and four output ports (a pair of ports 208, 210 on the left and a pair of opposite ports 212, 214 on the right). RF power input at the four input ports can be combined and directed by proper phase control to any one of the four output ports on the orthogonal arms. This 4×4 design is the equivalent of four hybrids with ports properly joined. For more convenient flange connections and to accommodate maintaining symmetry through the over-moded regions, asymmetric H-plane bend/tapers (e.g., asymmetric H-plane bend taper 216) to standard waveguide width are appended to the cross-potent ports in the figure. The figure shading indicates the electric field strength for an example in which RF power from the input ports 200, 202, 204, 206 is directed to the upper left output port 208 through the selection of appropriate phases of the RF signals at the input ports.

Note that the 4×4 design superhybrid, like the 2×2 hybrid design, has its waveguides all in a common plane (the H-plane). A straightforward extension in the plane of this 4×4 8-port device to 8×8 16-port device or 16×16 32-port device, however, leads to increasingly complicated and extensive layouts, requiring many bends and waveguide runs to connect component ports.

SUMMARY OF THE INVENTION

The present invention provides compact and elegant multi-port phase-directed power combiners. A multi-port passive waveguide network according to the invention allows RF power from multiple RF sources to be combined and directed to any of an equal number of output ports through control of the relative phases of the input RF power. These compact waveguide circuits provide an efficient means of instantly switching RF power between the output ports by drive phase manipulation. In another aspect, the devices can also be used in reverse as matched splitters.

Embodiments include 16-port (8×8) design and two 32-port (16×16) design configurations. Both the geometric arrangements and various unique component features of these networks provide advantageous improvements. The networks are symmetric. At the design frequency, each of the input ports is isolated from all of the others and equally coupled, with varying phase, to each of the output ports. These waveguide networks, composed solely of volume enclosed by metal walls, need no active components, dielectrics, ferrites, or any other materials.

In one aspect, the invention provides a high power RF phase-directed power combiner including a first 4×4 superhybrid RF waveguide in a first plane, a second 4×4 superhybrid RF waveguide in a second plane parallel to the first plane, a first RF waveguide circuit in a third plane, a second RF waveguide circuit in a fourth plane parallel to the third plane, where the third and fourth planes are orthogonal to the first and second planes, and E-plane bends connecting the first 4×4 superhybrid RF waveguide to the first RF waveguide circuit and the second RF waveguide circuit and connecting the second 4×4 superhybrid RF waveguide to the first RF waveguide circuit and the second RF waveguide circuit.

The first RF waveguide circuit may be a third 4×4 superhybrid RF waveguide, and the second RF waveguide circuit a fourth 4×4 superhybrid RF waveguide. Four such superhybrids in this arrangement may be duplicated, nested, and joined with interleaving E-plane bends to form a 16×16 combiner. Alternatively, the first RF waveguide circuit may be a first 2×2 magic H hybrid RF waveguide and the second RF waveguide circuit a second 2×2 magic H hybrid RF waveguide, forming an 8×8 combiner.

In another aspect, the invention provides a high power RF directive combining circuit comprising a first set of hybrid waveguides in a first set of multiple parallel planes, a second set of hybrid waveguides in a second set of multiple parallel planes orthogonal to the first set of parallel planes, and a set of waveguide twists connecting ports of the first set of hybrid waveguides to ports of the second set of hybrid waveguides.

DETAILED DESCRIPTION

Embodiments of the present invention provide passive waveguide circuits that have phase-directed switching capability of RF power from multiple inputs to any of multiple outputs using relatively compact geometries. These multi-port waveguide circuits allow agile combining and switching of power from multiple combined sources to any of multiple outputs using phase patterns. Several examples of such circuits are here realized, with different geometrical arrangements and port orientations. Conceptually, these designs are not necessarily bound to the particular sub-components used here for illustrative purposes. For example, the design principles of the combiners of the present invention encompass variations in particulars of hybrid design such as slots or posts, smooth twists, swept bend/tapers, and so on.

Figure 1:
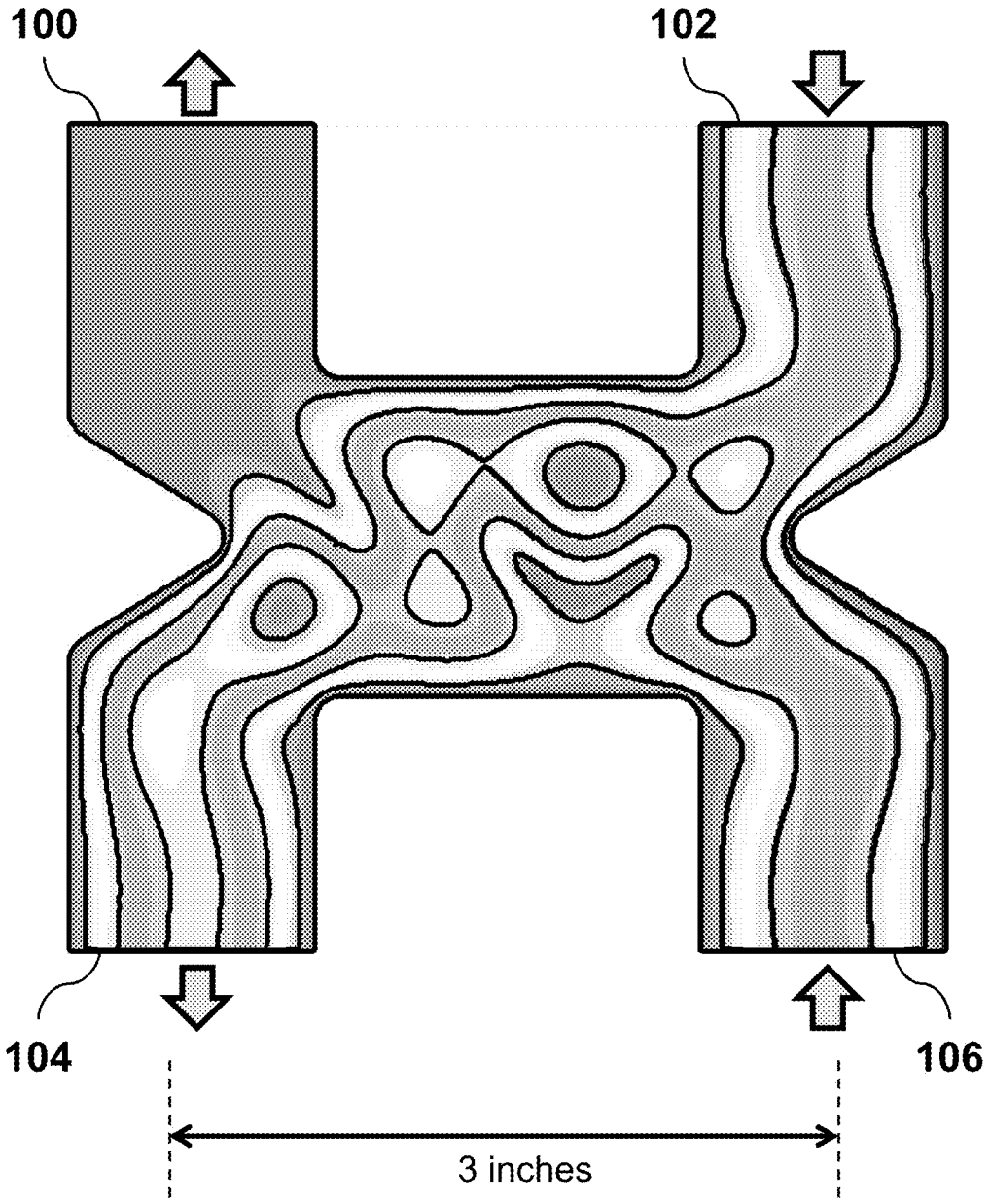
Fig. 1 (Prior Art)
FIG. 1 is a top view of an H-plane geometry design and electric field pattern for a 4-port "magic-H" waveguide hybrid device, introduced in 1999.
Figure 2:
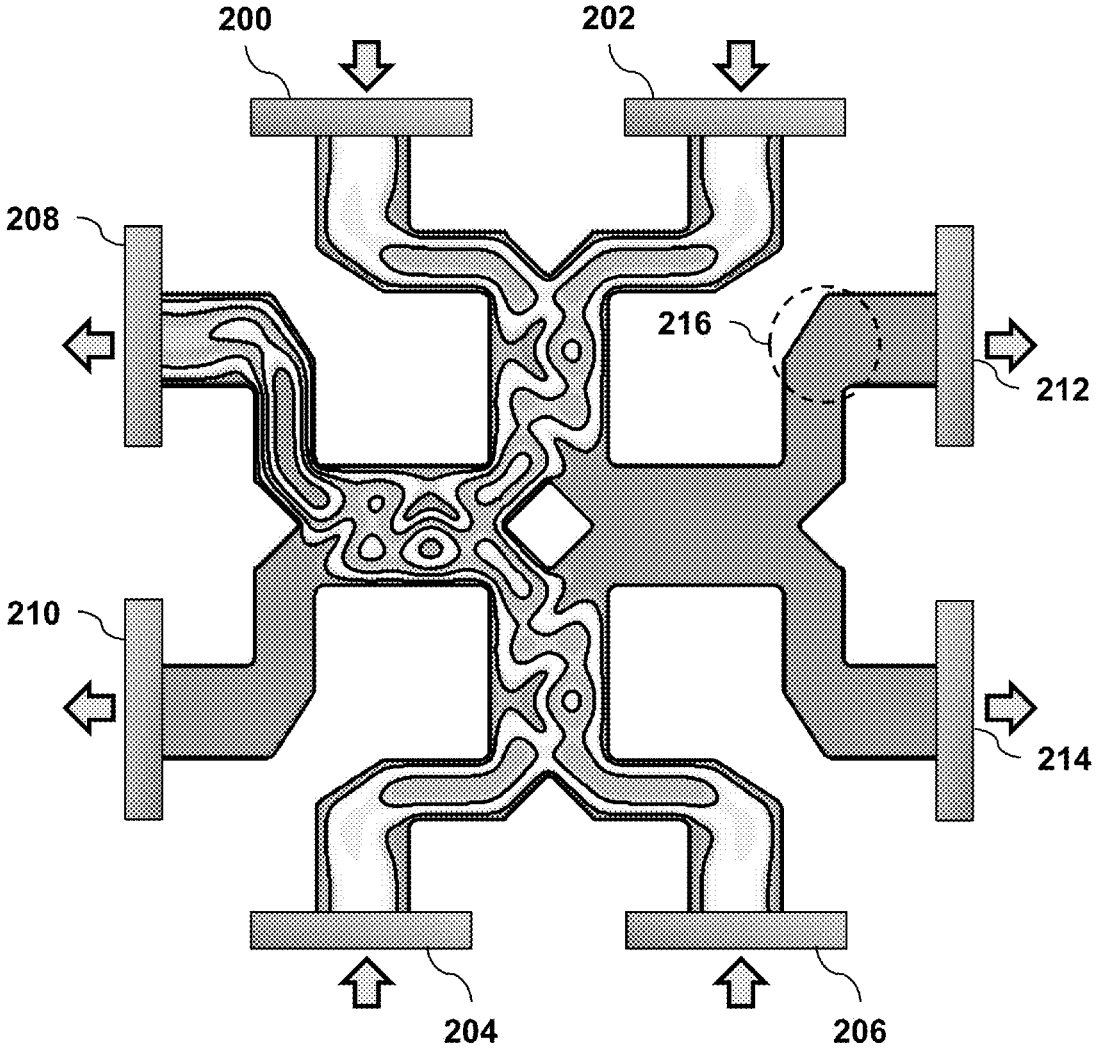
Fig. 2 (Prior Art)
FIG. 2 is a top H-plane view of planar geometry design and electric field pattern for an 8-port 4×4 "cross potent" superhybrid waveguide circuit.
Figure 3A:
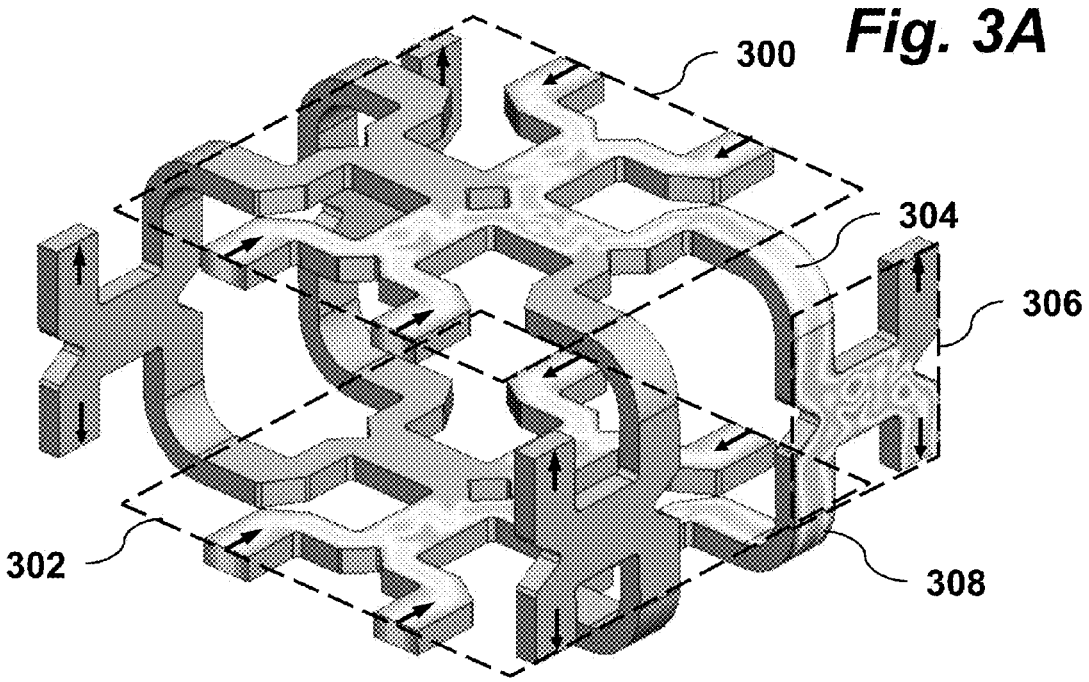
FIGS. 3A-B are perspective views of the 3D geometry and electric field pattern for two configurations of a 16-port 8×8 combining circuit composed of two cross potents feeding four magic-H's, according to embodiments of the present invention.
Figure 3B:
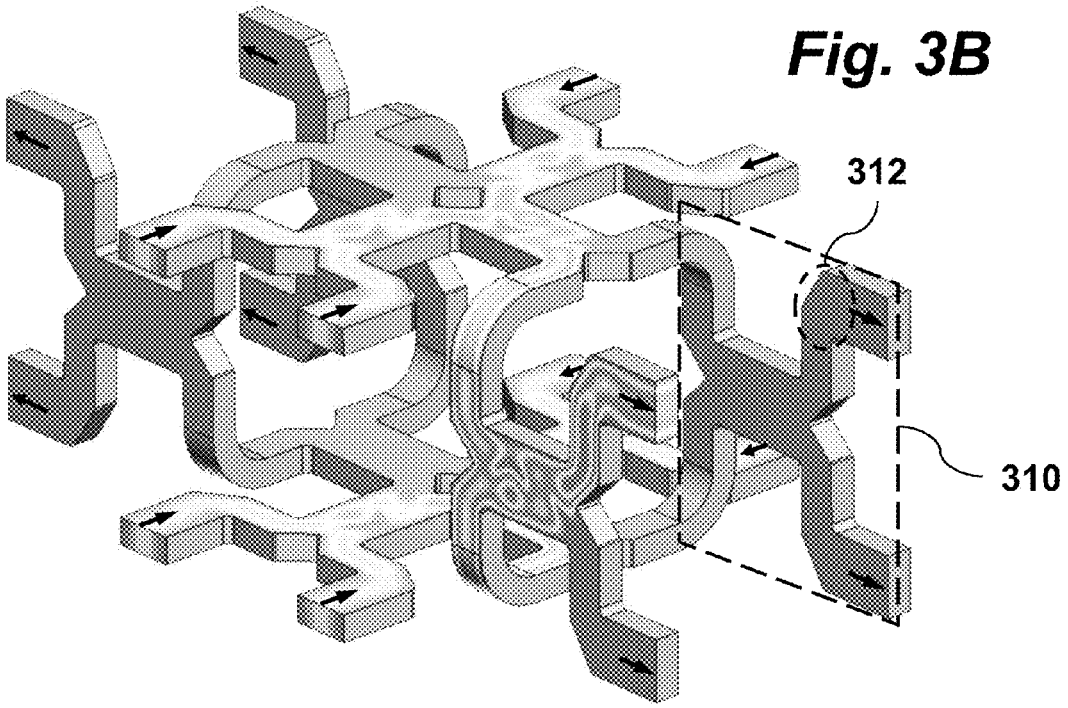

A 16-port combiner/splitter according to embodiments of the invention provide compact design by designing the circuit with waveguide components having their H-planes in multiple distinct planes, some of which are orthogonal to others, resulting in a 3D design. FIGS. 3A-B illustrate two such 3D waveguide circuit configurations, each composed of two cross potent superhybrids in parallel planes one above the other, with their output ports turned toward each other (before or after bend/tapers) through E-plane bends to feed into four magic-H hybrids, oriented in parallel planes orthogonal to the superhybrid planes. The design of FIG. 3A, for example, has superhybrids 300, 302 having their distinct H-planes parallel to each other. A magic-H hybrid 306 with its H-plane perpendicular to that of the superhybrids 300, 302 joins two arms of the superhybrids 300, 302 via E-plane bends 304 and 308, respectively. The superhybrid ports that are not joined serve as inputs, while the magic-H hybrid ports are outputs. Inputs and outputs are indicated in the figure with arrows. The waveguide shading shows RF power entering the 8 ports of superhybrids 300 and 302 being directed to one of the ports in magic-H hybrid 306. The design of FIG. 3B is analogous to that of FIG. 3A with two superhybrids joined through E-plane bends to four magic-H hybrids. In FIG. 3B, however, the orientation of the hybrids is in a different orthogonal plane than those in FIG. 3A, and the width transitions in FIG. 3A are before the magic-H hybrids, while the transitions in FIG. 3B are after. In the design of FIG. 3B, because the hybrids (e.g., 310) reflect the cross-potent interior dimensions, bend/taper transitions (e.g., 312) are used at the ports. Note that, though input-output exchange symmetry is not present in these two configurations, they are still functionally interchangeable: eight independent ports couple equally to another eight independent ports. This device contains, as it must, the equivalent of 12 hybrids.

Figure 4A:
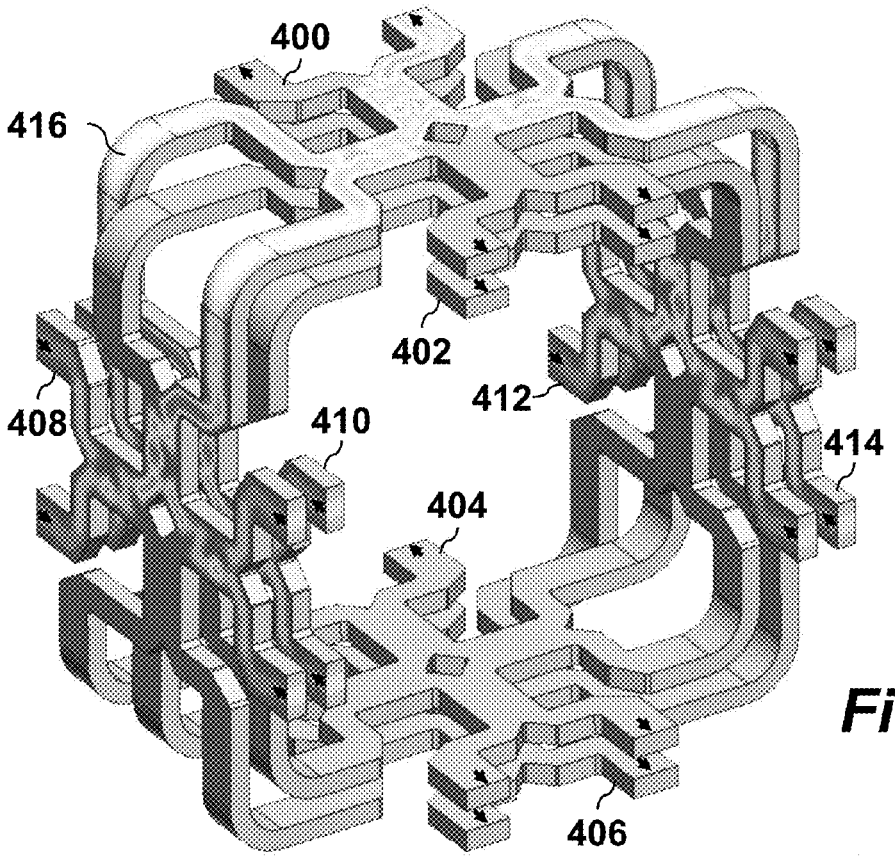
FIGS. 4A-C show perspective, side, and front views of a 32 port 16×16 cross potent "crown of thorns" combiner, according to embodiments of the present invention.
Figure 4B:
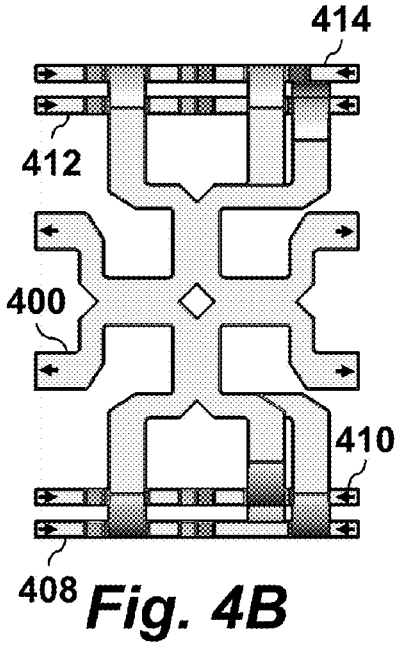
Figure 4C:
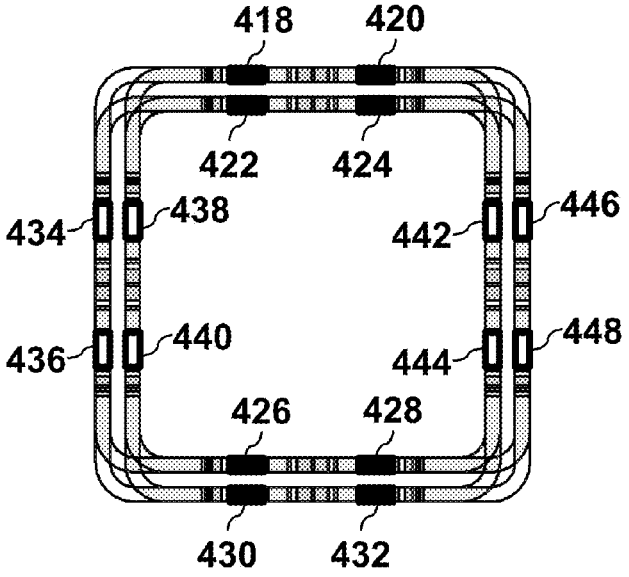

FIGS. 4A-C show a perspective view, side view, and front view, respectively, of a 32-port 16×16 design forming an interleaved, 3-D network device resembling a "crown of thorns." It is composed of eight cross potent superhybrids, with width-changing H-plane bends on all ports, arranged with a first set of four superhybrids 300, 302, 304, 306 stacked in four distinct parallel planes and a second set of four superhybrids 308, 310, 312, 314 stacked in four distinct parallel planes orthogonal to the first set of planes. The superhybrids are connected by E-plane bend connections (e.g., 316) to form an interleaved structure with inner and outer rings. Each cross potent superhybrid couples to both an inner and outer superhybrid on each adjacent perpendicular side. The 16 input ports emerging from the vertical planes couple to the 16 output ports emerging from the horizontal planes. FIG. 4C illustrates the front-facing 8 input ports 434, 436, 438, 440, 442, 444, 446, 448, and 8 output ports 418, 420, 422, 424, 426, 428, 430, 432. The other 8 input and other 8 output ports face the back. The top view of FIG. 4B shows superhybrid 400 and four orthogonal superhybrids 408, 410, 412, 414.

By comparison with the compact design of FIGS. 4A-C, FIG. 5 illustrates the conventional design of a 16×16 32-port device using successive combining (top to bottom). From the top down, 2×2 's (e.g., 500) are connected to make 4×4's; then 4×4's (e.g., 502) are connected to make 8×8's; and then 8×8's (e.g., 504) are connected to make the 16×16. Note the many line crossings, indicating waveguides which must pass each other, an obstacle to a simple planar solution. This complex and bulky design uses 32 hybrids whose H-planes are in a single common plane, for which 17 of 48 connecting waveguides must leave the plane for 44 cross-overs. The complexity and extent of such a circuit put together in a straightforward manner by simply laying out and connecting hybrids is apparent from this figure.

Figure 6A:
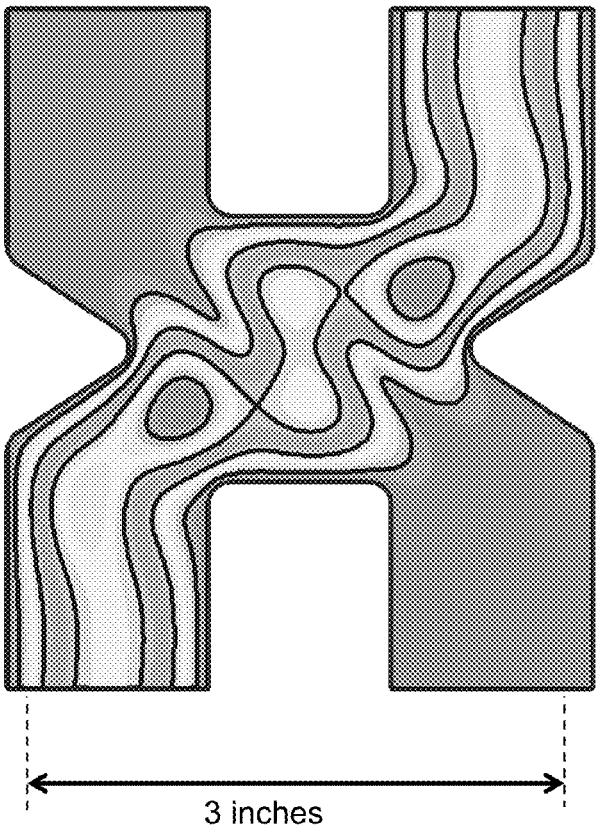
FIGS. 6A-B illustrate a "pass-through" 0-dB hybrid component and a step twist component, respectively, according to embodiments of the present invention.
Figure 6B:
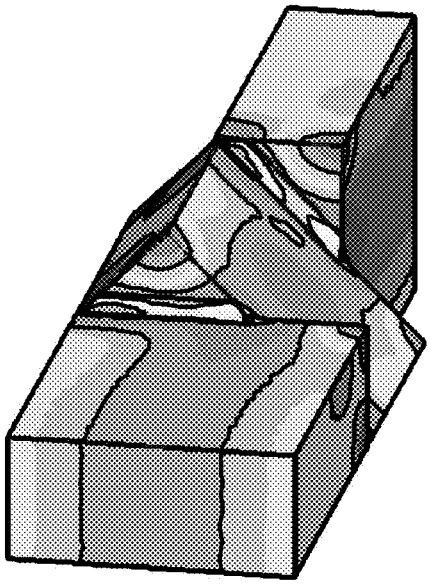

There are other approaches than merging and encircling to achieving appropriate connections between hybrids in combining circuits. Two such designs are made possible by incorporating either of the additional waveguide components pictured in FIGS. 6A and 6B. The first component, shown in FIG. 6A is a directional coupler of the magic-H type designed for 0 dB, rather than 3 dB, coupling—essentially a "pass through" that allows waveguides to cross in a plane without coupling. The second component, shown in FIG. 6B, is a waveguide twist. In the particular "step twist" design shown, simply orthogonal end segments are connected (with edges rounded) by a short 45° segment of such length that the discontinuity mismatches cancel at the design frequency. This component offers a compact rather than broadband option.

Figure 5:
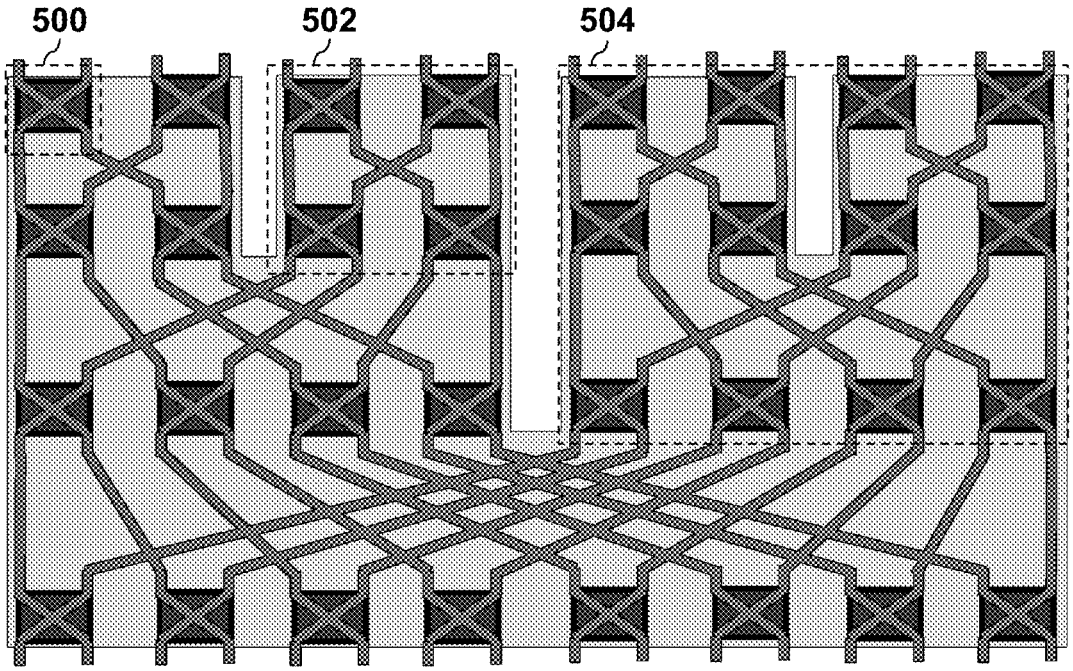
FIG. 5 is a schematic of an equivalent 2-D layout of the device of FIG. 4A-C.
Figure 7:
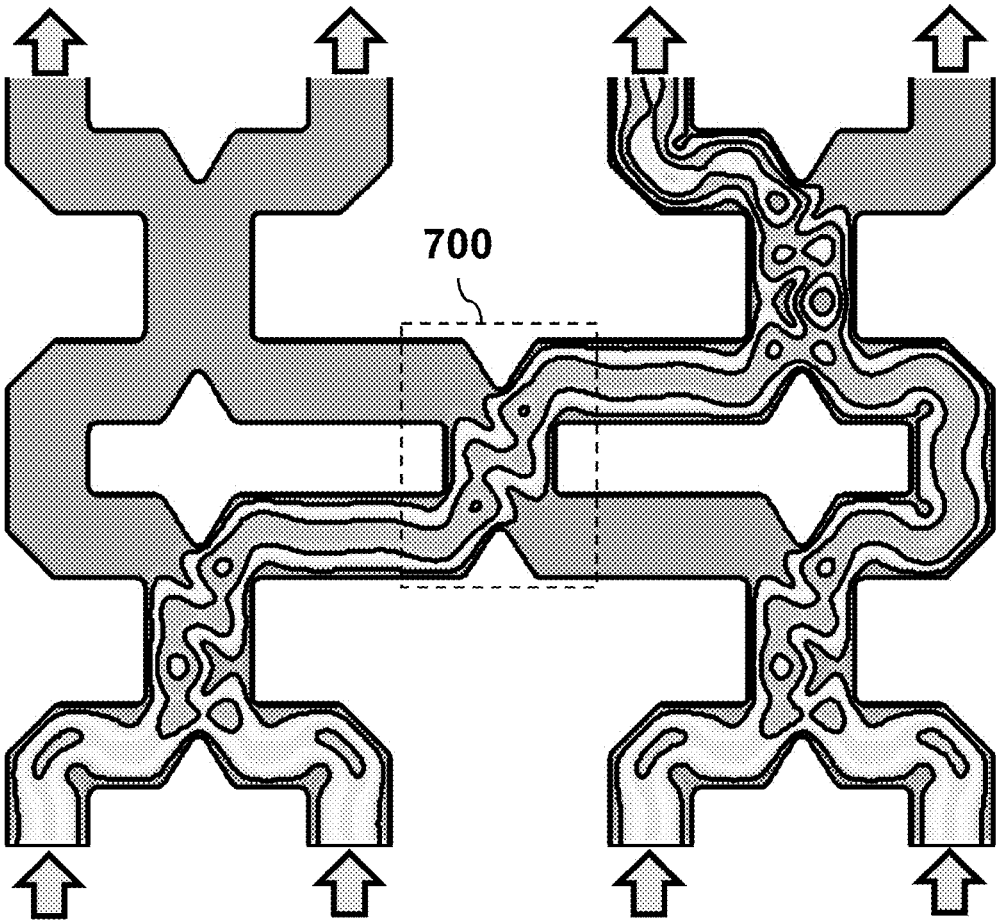
FIG. 7 is a top view of a planar 8-port 4×4 combining circuit composed of four hybrids joined by a pass through component, according to embodiments of the present invention.

Now, the pass through of FIG. 6A can be used in the middle of a 4-hybrid pattern, such as those that constitute the top two rows of FIG. 5, to allow the cross-over connection without leaving the plane. This is illustrated in the 8-port 4×4 combining circuit of FIG. 7, which is composed of four hybrids joined by "pass through" 700. In this design, the bottom 4 inputs phase combine into any of the top 4 outputs.

Figure 8:
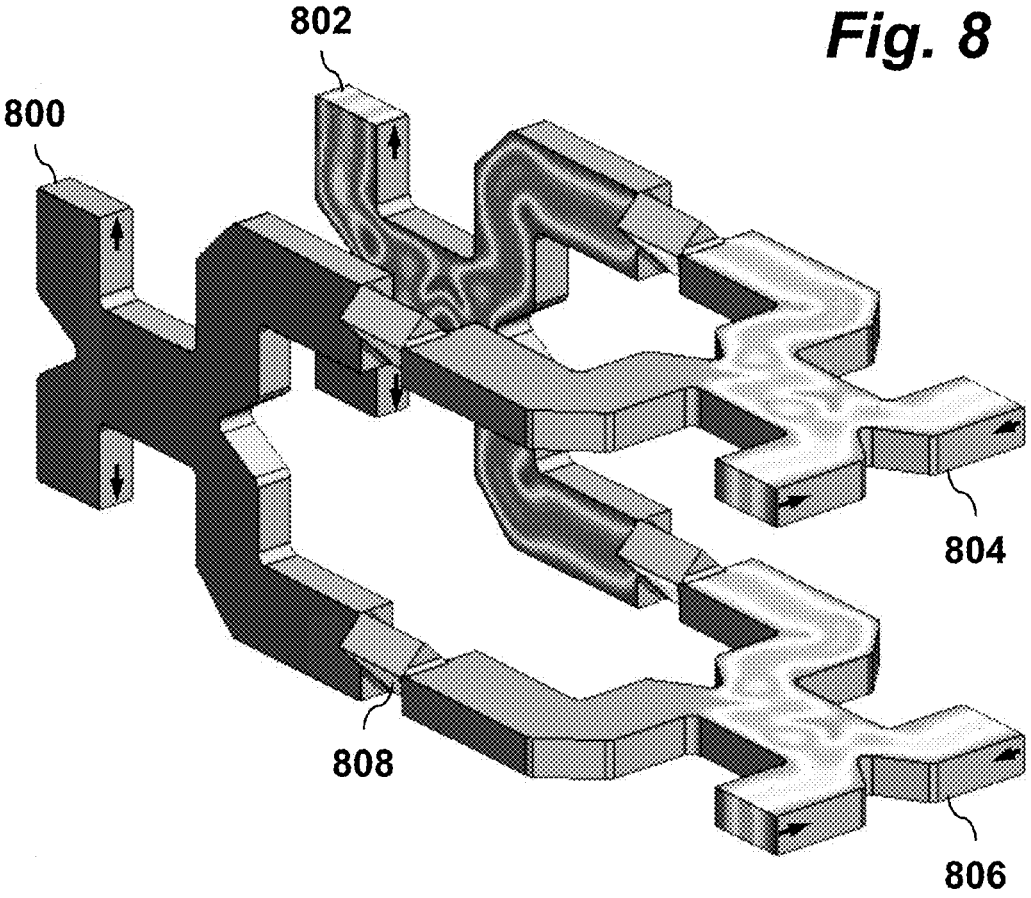
FIG. 8 is a perspective view of an 8-port 4×4 combining circuit composed of four hybrids and four waveguide twists, according to embodiments of the present invention.

As shown in FIG. 8, an 8-port 4×4 combining circuit composed of four hybrids and four waveguide twists has the outputs of one pair of hybrids connected to the inputs of another by stacking each pair and rotating one 90° with respect to the other such that the ports line up. In particular, hybrids 800 and 802 are in distinct parallel planes, while hybrids 804 and 806 are in distinct parallel planes orthogonal to the first two planes. A twist (e.g., 808) such as in FIG. 6B is then used for each connection between the lined up ports to rotate the polarization. The resulting 4×4 combining circuit looks like the simulated model of FIG. 8, with horizontal inputs and vertical outputs. The shading shows RF power being directed from the four input ports of hybrids 804 and 806 to a single output of hybrid 802.

Figure 9:
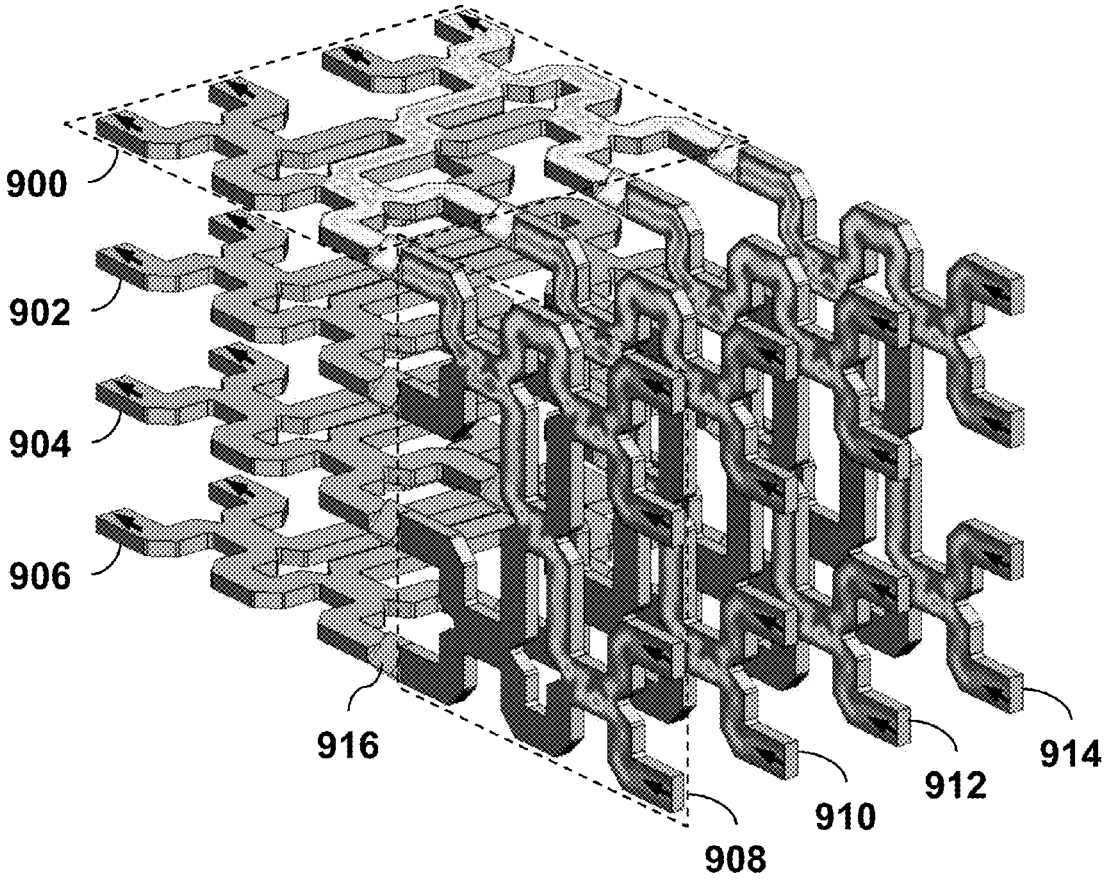
FIG. 9 is a perspective view of a 32-port 16×16 directive combining circuit composed of 32 hybrids, 8 pass throughs and 16 waveguide twists, according to embodiments of the present invention.

An alternate design of a 32-port 16×16 directive combining circuit composed of 32 hybrids, 8 pass throughs and 16 waveguide twists is shown in FIG. 9. This design combines the latter two concepts, providing another 3-D 16×16 "phased array" combining circuit. This device is composed of two sets of four stacked 4×4 combining circuits of FIG. 7, a first set 900, 902, 904, 906 in stacked parallel planes, and a second set 908, 910, 912, 914 in stacked parallel planes oriented orthogonal to the first set of parallel planes and arranged such that the 16 ports of one stack line up with the 16 ports of the other stack. The 16 lined up ports of the two sets of stacked circuits are connected by 16 twists (e.g., 916) at their lined-up ports. This network is the functional equivalent of the design in FIG. 4, though the very different geometries offer different port orientations. The shading in the figure illustrates an example in which RF power input to the 16 ports of circuits 908, 910, 912, 914 is directed to a single output port of circuits 900, 902, 904, 906.

Figure 10:
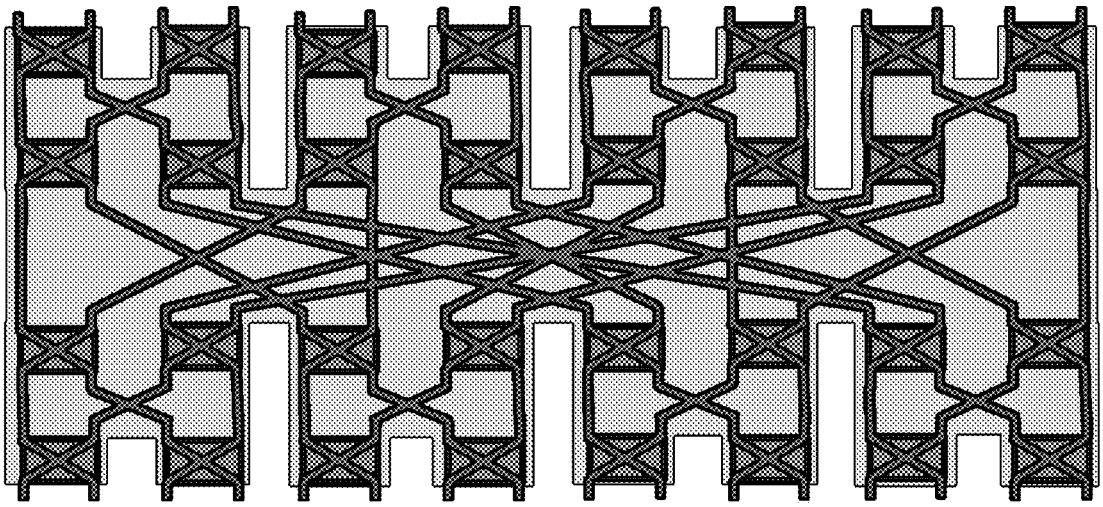
FIG. 10 is a schematic of an equivalent 2-D layout of the device of FIG. 9.

While FIG. 5 illustrates successive binary levels of combining, note that both of the 16×16 circuits are more accurately described by the equivalent 2-D layout of FIG. 10. The 8×8 stage is avoided by connecting four 4×4 circuits. The number of hybrids, connections and cross-overs in the planar layout is the same.

The RF devices described above may be designed to operate at arbitrary RF frequency, in appropriate waveguide, the pictured examples being for 9.3 GHz in WR112, for several waveguide combining circuits with equal numbers of input and output ports. Properly optimized, each input port is matched, uncoupled from the others, and equally coupled to each of the output ports (and vice versa). With equal power in each input and independent phase control, any combination of output power division, in particular full combining to any one, is possible.

Employing these unique 3D designs as well as unique component designs, embodiments of 8×8 and 16×16 combiners have been described above. Based on the principles of the invention described herein, variations of these designs are also possible. In addition, it may be possible to conceive a next-level 32×32 combiner geometry using the principles of the present invention (though a $4^{th}$ dimension is unavailable). Such a device design would incorporate 80 hybrids, or their equivalent.

It should be understood by those skilled in the art that various sub-components of alternate design could be substituted for the components shown in the specific embodiments described herein without departing from the scope of the invention. For example, such alternative components may include a standard waveguide twist, swept bend/taper (curved walls), mitred E-plane bend, slotted hybrid, biplanar coupler, and so on.

Embodiments of the invention advantageously allow the use of smaller RF amplifiers than otherwise required and, more significantly, allow the input power to be combined and selectively directed to any of several different output ports in quick succession by means of applied drive signal phase patterns.

Expressing the port fields in complex notation, where 1, i, −1 and −i represent respectively 0°, 90°, 180° and −90° phases, the scattering matrix of a (lossless) 2×2 hybrid and its directive combining function with appropriate inputs can be represented as follows:

$$S = \frac{1}{\sqrt{2}}\begin{pmatrix} 0 & 0 & 1 & i \\ 0 & 0 & i & 1 \\ 1 & i & 0 & 0 \\ i & 1 & 0 & 0 \end{pmatrix} \Rightarrow S\begin{pmatrix} 1 \\ -i \\ 0 \\ 0 \end{pmatrix} = \begin{pmatrix} 0 \\ 0 \\ \sqrt{2} \\ 0 \end{pmatrix},$$

$$S\begin{pmatrix} -i \\ 1 \\ 0 \\ 0 \end{pmatrix} = \begin{pmatrix} 0 \\ 0 \\ 0 \\ \sqrt{2} \end{pmatrix}$$

For the 4×4 superhybrid, the scattering matrix grows to the following:

$$S = \frac{1}{2}\begin{pmatrix} 0 & 0 & i & -1 & 0 & 0 & i & 1 \\ 0 & 0 & 1 & i & 0 & 0 & -1 & i \\ i & 1 & 0 & 0 & i & -1 & 0 & 0 \\ -1 & i & 0 & 0 & 1 & i & 0 & 0 \\ 0 & 0 & i & 1 & 0 & 0 & i & -1 \\ 0 & 0 & -1 & i & 0 & 0 & 1 & i \\ i & -1 & 0 & 0 & i & 1 & 0 & 0 \\ 1 & i & 0 & 0 & -1 & i & 0 & 0 \end{pmatrix}$$

Phase patterns that lead to combining to selective ports for this are shown below.

$$\Rightarrow S\begin{pmatrix}0\\0\\-i\\-1\\0\\0\\-i\\1\end{pmatrix}=\begin{pmatrix}2\\0\\0\\0\\0\\0\\0\\0\end{pmatrix},S\begin{pmatrix}0\\0\\1\\-i\\0\\0\\-1\\-i\end{pmatrix}=\begin{pmatrix}0\\2\\0\\0\\0\\0\\0\\0\end{pmatrix},S\begin{pmatrix}0\\0\\-i\\1\\0\\0\\-i\\-1\end{pmatrix}=\begin{pmatrix}0\\0\\0\\0\\2\\0\\0\\0\end{pmatrix},S\begin{pmatrix}0\\0\\-1\\-i\\0\\0\\1\\-i\end{pmatrix}=\begin{pmatrix}0\\0\\0\\0\\0\\2\\0\\0\end{pmatrix}$$

Note that the output power is proportional to the square of the field, so that it is here four times the normalized input powers.

Though unwieldy to display in this text, the extension up to our 16×16 combiners is straight forward. With the factor in front going to ¼, the 32×32 S-matrix, with proper port numbering and phase references, is a symmetric matrix composed of an orthogonal set of column/row vectors, each of which has 16 zeroes and 16 elements of unit amplitude and various phases aligned to the complex axes.

Since the S-matrix inverse is the conjugate transpose, the phase combination needed for combining to a port n can be determined by taking the complex conjugate the $n^{th}$ row, i.e. from:

$$SS^{T*}=SS^{-1}=\begin{pmatrix}1&0&0\\0&\ddots&0\\0&0&1\end{pmatrix}\Rightarrow S\begin{pmatrix}S_{n1}^*\\\vdots\\S_{nN}^*\end{pmatrix}=\begin{pmatrix}\vdots\\1\\\vdots\end{pmatrix}_n$$

The technology is well established to allow a low-level RF (LLRF) system to control and manipulate the relative phases of the drives to multiple RF amplifiers, with fast switching, from the same phase reference.

One important application of the devices of the present invention is in medical applications where it allows multi-angle irradiation of tumors on a time scale fast compared to bodily movements—thus increasing accuracy and effectiveness while limiting collateral tissue damage—without the unrealistic expense of a 16 times higher power individual RF source for each linac. Specifically, devices of the present invention allow for sequentially powering a set of medical linacs arranged around a patient to provide fast multi-angle radiation therapy without a turning gantry. For example, embodiments of the invention may be used in systems such as that disclosed in U.S. Pat. No. 8,618,521, which is incorporated herein by reference. Other uses are envisioned in areas such as industry and materials detection. With loads on all but one output port, they can be used simply as matched multi-source combiners, or in reverse as 16-way splitters.

The invention claimed is:

1. An 8 input×8 output high power phase-directed RF power combiner comprising:

a first 4×4 (8-port) cross potent superhybrid waveguide circuit;

a second 4×4 (8-port) cross potent superhybrid waveguide circuit;

wherein each of the first and the second cross potent superhybrids is an equivalent of four hybrids radially arranged and merged, with waveguides all in a common plane (the H-plane);

wherein the first 4×4 (8-port) cross potent superhybrid and the second 4×4 (8-port) cross potent superhybrid are in a first set of parallel planes;

a first RF waveguide circuit, wherein the first RF waveguide circuit comprises a first pair of magic H 2×2 H-plane waveguide hybrids;

a second RF waveguide circuit, wherein the second RF waveguide circuit comprises a second pair of magic H 2×2 H-plane waveguide hybrids; and wherein the first RF waveguide circuit and the second RF waveguide circuit are in a second set of parallel planes orthogonal to the first set of parallel planes;

eight E-plane waveguide bends, wherein a first four of the eight E-plane bends connect the first 4×4 cross potent superhybrid to each hybrid in the first RF waveguide circuit and to each hybrid in the second RF waveguide circuit, and wherein a second four of the eight E-plane bends connect the second 4×4 cross potent superhybrid RF waveguide to each hybrid in the first RF waveguide circuit and to each hybrid in the second RF waveguide circuit.

2. A 16 input×16 output high power RF phase-directed power combiner comprising:

a first pair of 4×4 (8-port) cross potent superhybrids;

a second pair of 4×4 (8-port) cross potent superhybrids;

wherein the first pair of 4×4 (8-port) cross potent superhybrids and the second pair of 4×4 (8-port) cross potent superhybrids are stacked in a first set of parallel planes;

a third pair of 4×4 (8-port) cross potent superhybrids;

a fourth pair of 4×4 (8-port) cross potent superhybrids;

wherein the third pair of 4×4 (8-port) cross potent superhybrids and the fourth pair of 4×4 (8-port) cross potent superhybrids are stacked in a second set of parallel planes orthogonal to the first set of parallel planes;

sixteen waveguide bends, wherein a first eight of the sixteen waveguide bends connect the first pair of 4×4 (8-port) cross potent superhybrids to the third pair of 4×4 (8-port) cross potent superhybrids and to the fourth pair of 4×4 (8-port) cross potent superhybrids, and wherein a second eight of the sixteen waveguide bends connect the second pair of 4×4 (8-port) cross potent superhybrids to the third pair of 4×4 (8-port) cross potent superhybrids and to the fourth pair of 4×4 (8-port) cross potent superhybrids.

3. A 4 input×4 output high power phase-directed RF power combiner comprising:

a first set of two 2×2 waveguide hybrids stacked in a first set of two distinct parallel planes;

a second set of two 2×2 waveguide hybrids stacked in a second set of two distinct parallel planes orthogonal to the first set of two parallel planes;

a set of four waveguide twists connecting four output ports of the first set of two 2×2 hybrid waveguides to four input ports of the second set of two 2×2 waveguide hybrids, wherein the four waveguide twists are rotational twists around a longitudinal waveguide axis.

4. The 4 input×4 output high power phase-directed RF power combiner of claim 3, wherein the first set of two 2×2 waveguide hybrids and the second set of two 2×2 waveguide hybrids are magic H hybrids.

5. The 4 input×4 output high power phase-directed RF power combiner of claim 3, wherein each of the waveguide twists comprises simply orthogonal end segments connected with edges rounded by a 45° segment, where a length of the 45° segment is selected such that discontinuity mismatches cancel at a design frequency.

6. A 16 input×16 output high power phase-directed RF power combiner comprising:

a first set of four 4×4 phase directed combining circuits stacked in a first set of distinct parallel planes;

a second set of four 4×4 phase directed combining circuits stacked in a second set of distinct parallel planes orthogonal to the first set of distinct parallel planes;

a set of 16 waveguide twists connecting 16 output ports of the first stack to 16 input ports of the second stack, wherein the 16 waveguide twists are rotational twists around a longitudinal waveguide axis;

wherein each of the four 4×4 phase directed combining circuits in the first and second sets of four 4×4 phase directed combining circuits is composed of four hybrids joined by a magic H passthrough.

7. The 16 input×16 output high power phase-directed RF power combiner of claim 6 wherein the four hybrids joined by a passthrough comprise four 3-dB hybrids arranged parallel in a 2×2 pattern in a single plane, with a 0 dB coupler located at a center of the pattern in the same plane.

8. The 16 input×16 output high power phase-directed RF power combiner of claim 6, wherein each of the 16 waveguide twists comprises simply orthogonal end segments connected with edges rounded by a 45° segment, where a length of the 45° segment is selected such that discontinuity mismatches cancel at a design frequency.

* * * * *